United States Patent [19]

Hoogendoorn et al.

[11] Patent Number: 4,698,103

[45] Date of Patent: Oct. 6, 1987

[54] METHOD OF MANUFACTURING DUAL PHASE STRIP STEEL AND STEEL STRIP MANUFACTURED BY THE METHOD

[75] Inventors: Thomas M. Hoogendoorn, Aerdenhout; Maarten A. de Haas, Heerhugowaard; Johan M. Nijman, Bergen, all of Netherlands

[73] Assignee: Hoogovens Groep B.V., Ijmuiden, Netherlands

[21] Appl. No.: 837,195

[22] Filed: Mar. 10, 1986

[30] Foreign Application Priority Data

Mar. 8, 1985 [NL] Netherlands ..... 8500658

[51] Int. Cl.[4] ..... C21D 8/02

[52] U.S. Cl. ..... 148/12 F; 148/320; 427/388.1; 204/44.4; 204/373

[58] Field of Search ..... 148/12 F, 36, 12 B, 148/31.5, 320; 428/606; 204/44.4, 37.3; 427/388.1

[56] References Cited

U.S. PATENT DOCUMENTS 3,378,360 9/1984 McFarland ..... 428/606
4,062,700 12/1977 Hayami et al. ..... 148/12 F

FOREIGN PATENT DOCUMENTS 0053913 6/1982 European Pat. Off. ..... 148/12 F
5246323 4/1974 Japan ..... 148/12 F
2028690 3/1980 United Kingdom ..... 148/12 F

OTHER PUBLICATIONS

Metals Handbook, Ninth Edition, vol. 5, "Surface Cleaning, Finishing and Coating," pp. 351, 471, 497.

*Primary Examiner*—L. Dewayne Rutledge
*Assistant Examiner*—Deborah Yee
*Attorney, Agent, or Firm*—Stevens, Davis, Miller & Mosher

[57] ABSTRACT

In a method of manufacturing a dual phase steel a strip of thickness 0.1 to 0.5 mm from an unalloyed low C, low Mn steel composition of 0.02–0.15% C and 0.15–0.50% Mn, which method includes continuous annealing, a flat product can be obtained without strip fracture if (a) the strip is heated to not above 770° C. in the $A_1$–$A_3$ region of the iron-carbon diagram region and thereafter (b) the strip is cooled sufficiently rapidly that austenite is at least partly converted to martensite and/or bainite, the cooling rate is such that the value P=d.V where d is strip thickness in mm and V is average cooling rate in °C/sec from 700° C. to 300° C., is in the range 20 to 900 and the time interval between the end of step (a) and the beginning of step (b) is less than 4 seconds.

18 Claims, 4 Drawing Figures

| C | Mn | P | S | Si | $AL_{as}$ | Cu | Sn | Cr | Ni | $N_{tot}$ | Fe |
|---|---|---|---|---|---|---|---|---|---|---|---|
| 82 | 360 | 11 | 18 | 9 | 46 | 36 | 6 | 23 | 30 | 26 | balance |

fig. 1

| Nr | Code | VLGR | TRST | R30T | A80 | thickness | Remarks*) |
|---|---|---|---|---|---|---|---|
| 1 | D | 451 | 699 | 77,1 | 13,8 | 0,224 | A |
| 2 | D | 472 | 707 | 77,4 | 15,0 | 0,223 | A |
| 3 | D | 403 | 575 | 70,7 | 20,6 | 0,223 | A,C |
| 4 | D | 396 | 563 | 71,4 | 19,4 | 0,227 | A,C |
| 5 | D | 435 | 551 | 71,8 | 18,6 | 0,231 | A,E |
| 6 | D | 444 | 568 | 73,2 | 17,5 | 0,228 | A,E |
| 7 | D | 579 | 742 | 77,7 | 10,1 | 0,221 | A,B |
| 8 | D | 572 | 739 | 77,9 | 10,7 | 0,221 | A,B |
| 9 | D | 525 | 616 | 73,1 | 13,8 | 0,219 | A,B,C |
| 10 | D | 517 | 615 | 73,7 | 13,6 | 0,221 | A,B,C |
| 11 | D | 523 | 579 | 72,5 | 11,0 | 0,220 | A,B,E |
| 12 | D | 541 | 590 | 73,4 | 11,2 | 0,221 | A,B,E |

*) A = annealed B = 1% skin pass rolled
C = tinplated and reflowed at 230°C for 10 sec.
E = lacquered and baked at 200°C for 10 min.

fig. 3

METHOD OF MANUFACTURING DUAL PHASE STRIP STEEL AND STEEL STRIP MANUFACTURED BY THE METHOD

BACKGROUND OF THE INVENTION

1. Field of the Invention

This invention relates to a method of manufacturing dual phase strip steel and steel strip manufactured by the method. In particular the invention relates to a method of manufacturing a dual phase steel in the form of a strip of thickness in the range 0.1 to 0.5 mm from an unalloyed low C, low Mn steel composition having by weight 0.02–0.15% C 0.15–0.50% Mn comprising the steps of hot rolling cold rolling continuous annealing the continuous annealing comprising (a) heating the strip into the $A_1$–$A_3$ region of the iron-carbon diagram and soaking it in said region and thereafter (b) cooling the strip sufficiently rapidly that austenite is at least partly converted to martensite and/or bainite. Steel strip of this thickness is known as packing steel, because it may be used for various packaging functions, e.g. as tinplate.

2. Description of the Prior Art

A method as outlined above is disclosed in NL-A-8512364 which is discussed below.

Dual phase steels are now well known, and their production by continuous annealing is also well known. Dual phase steel is available either hot rolled, in a thickness of approximately 1.5–100 mm, or cold rolled, in a thickness of approximately 0.8–3 mm. See for example No. WO-79/00644 and EP-A No. 53913 which relates to steels for automotive applications (i.e. 0.8 mm thick in practice) and disclose steels which contain the alloying elements P and Si.

However, the production of thin strip of dual phase steel, i.e. with a thickness of 0.1–0.5 mm, presents a problem, because the known methods from producing the steel in greater thicknesses cannot be directly applied. One difficulty is to maintain the flatness of the strip.

Typically in the production of a strip of dual phase steel, the steel is quenched in cold water after heating in the continuous annealing line. During this cooling the cooling rate may be 1000° C./sec. for a strip thickness of 1 mm. The cooling rate is inversely proportional to the thickness of the strip. Thus cooling a 1 mm thick strip at 1000° C./sec. represents a P value of 1000 mm °C./sec. where P is the product of cooling rate and strip thickness. If quenching in cold water is used as a cooling process for steel 0.1 to 0.5 mm thick, the strip will not remain flat because of thermal stresses, with the result that no strip of acceptable shape can be obtained.

NL-A No. 6512364 describes the production of thin strip of dual phase steel using cold water quenching, but it appears that the product obtained was not flat since in the examples given the product is subjected to a further rolling to make it flat. This is undesirable not only because of the cost of an extra step but also because the rolling introduces stresses which will cause further difficulties when the strip is cut.

Other cooling processes are known in the art and are likely to reduce or avoid the problems relating to strip shape where thin material is treated, e.g. gas (air) jet cooling with a P value of about 10 mm °/sec., or quenching in hot water with a P value of about 25 mm °C./sec. However another difficulty then presents itself, which is to ensure the desired production of only or mainly martensite and/or bainite when using unalloyed low C, low Mn steel. With known treatments, this is achieved only if the strip is heated high in the $A_1$–$A_3$ range, e.g. at about 850° C., in the continuous annealing line. At such high temperatures strip fracture frequently occurs. Under the influence of the tensile force required for passing the strip through the continuous annealing line, the strip then collapses because of the low value of the yield point at that high temperature and the small supporting cross section of the thin material.

Strip fracture is very disadvantageous in continuous annealing. Not only is it very time consuming to feed the strip through the continuous annealing line again, with the resultant production loss, but strip material is lost when the continuous annealing line is restarted, until the desired process conditions are restored.

SUMMARY OF THE INVENTION

One object of the invention is to provide a method for manufacturing dual phase packing steel with a thickness of 0.1–0.5 mm from unalloyed low C, low Mn steel, in which the problems described above are completely or largely eliminated, in particular in which strip flatness is obtained and strip fracture is avoided.

This object can be achieved by the invention in which the combination of conditions for continuous annealing is carefully selected.

According to the invention, in the method described initially above, in the continuous annealing, in said step (a) the strip is heated to a temperature not exceeding 770° C., in said step (b) the strip is cooled at a rate such that the value $P=d.V$, where d is the strip thickness in mm and V is the average cooling rate in °C./sec over the temperature range 700° to 300° C., is in the range 20 to 900 and the time interval between the end of step (a) and the beginning of step (b) is less than 4 seconds.

This chosen combination achieves the desired results for the following reasons.

Firstly, the temperature to which the strip is heated in the $A_1$–$A_3$ region is so low that strip fracture does not occur as a result of the tensile force applied when passing the strip through the continuous annealing line. Secondly, the procedure for cooling the strip is adapted to the low temperature to which the strip is heated so that nevertheless the austenite is at least partly converted to martensite and/or bainite to form the desired dual phase, while the strip remains completely, or almost completely, flat. The cooling procedure involves a P value which is less than that which causes deformation of the strip but is sufficient that the dual phase structure is obtained. Most importantly the strip is fed to the cooling section, over the gap between the end of the heating section and the cooling section with little or no temperature loss, i.e. the time interval between these sections must be, as mentioned, less than 4 seconds and should be as short as possible, i.e. preferably less than 2 seconds, more preferably less than 1 second and most preferably less than 0.5 seconds. This ensures that the cooling curve does not enter a region where undesired structure changes occur.

It is remarked that in known continuous annealing lines the gap between the heating section and the cooling section is so great that very thin material, if heated to less than 800° C., is cooled by natural cooling before reaching the cooling section to such an extent that no martensite and/or bainite is formed in the cooling section. Using the above method, however, it is possible to manufacture dual phase steel with a thickness of 0.1 to 0.5 mm which is sufficiently flat, using a normal unalloyed steel composition. Strip thickness in the range 0.1 to 0.3 mm is preferred.

The strip is preferably heated in the continuous annealing to a temperature of less than 750° C., and cooling preferably takes place at a P value in the range 40–750 mm °C./sec., more preferably 75 to 500 mm °C./sec.

The preferred cooling method is to direct or spray a coolant in the form of a mist of a gas (such as air) and a cooling fluid (such as water) onto the strip for cooling. This is known in the art as a mist jet. The cooling capacity of the cooling process should be adapted to the strip thickness and to the strip speed by varying the quantity of cooling fluid sprayed per sprayer and the number of sprayers.

There is preferably used an Al killed steel having a normal chemical composition, containing 0.02–0.10% C, and 0.15–0.50% Mn. This saves the cost of martensite-forming alloying elements.

In general, the preferred steel used in the invention is an Al killed steel containing by weight 0.02–0.15% C
0.15–0.50% Mn
not more than 0.02% P
not more than 0.03% Si
not more than 0.065% $Al_{as}$
not more than 0.02% S
not more than 50 ppm N
balance Fe and unavoidable impurities.

Thus the elements Cu, Ni, Cr and Mo for example are typically at impurity levels.

After cooling, the steel is preferably tempered in accordance with the mechanical properties required for the intended use.

In the case of electrolytically tinned packing steel, the steel should preferably be tempered for about 5 to 10 seconds at about 230° C., during reflowing of the tin layer.

In the case of lacquered packing steel, the steel should preferably be tempered for about 10 minutes at about 200° C., whilst the layer of lacquer is baked.

The invention also extends to steel manufactured by the method according to the invention, with a thickness of 0.1–0.5 mm, and having a tensile strength exceeding 500N/mm$^2$, and an elongation at rupture $A_{80}$ greater than 5%. Such a steel with these properties is not known. Furthermore the invention also extends to packing steel manufactured by the method according to the invention with a thickness of 0.1–0.5 mm which is of one of the qualities T65 and T70 (see European Standard 145-78) or is of a quality which corresponds in hardness to double cold rolled DR8 and DR9 (see Tinmill Products, May 1979, page 20).

Other details and features of the invention will stand out from the description given below by way of non-limitative example and with reference to the accompanying drawings, in which:

FIG. 1 shows a chemical analysis of an Al killed low carbon unalloyed converter steel;

FIG. 3 shows properties of the steel of FIG. 1 as a result of various treatments.

The preferred embodiment of the invention will now be described.

EXAMPLE

An Al killed low carbon, unalloyed converter steel, with a chemical analysis as shown in the table of FIG. 1 of the accompanying drawings, was hot rolled and coiled at a temperature of 650° C. The hot rolled steel was then pickled and cold rolled to a thickness of 0.22 mm. The strip width was 150 mm and its length about 2 km.

Figure 2:
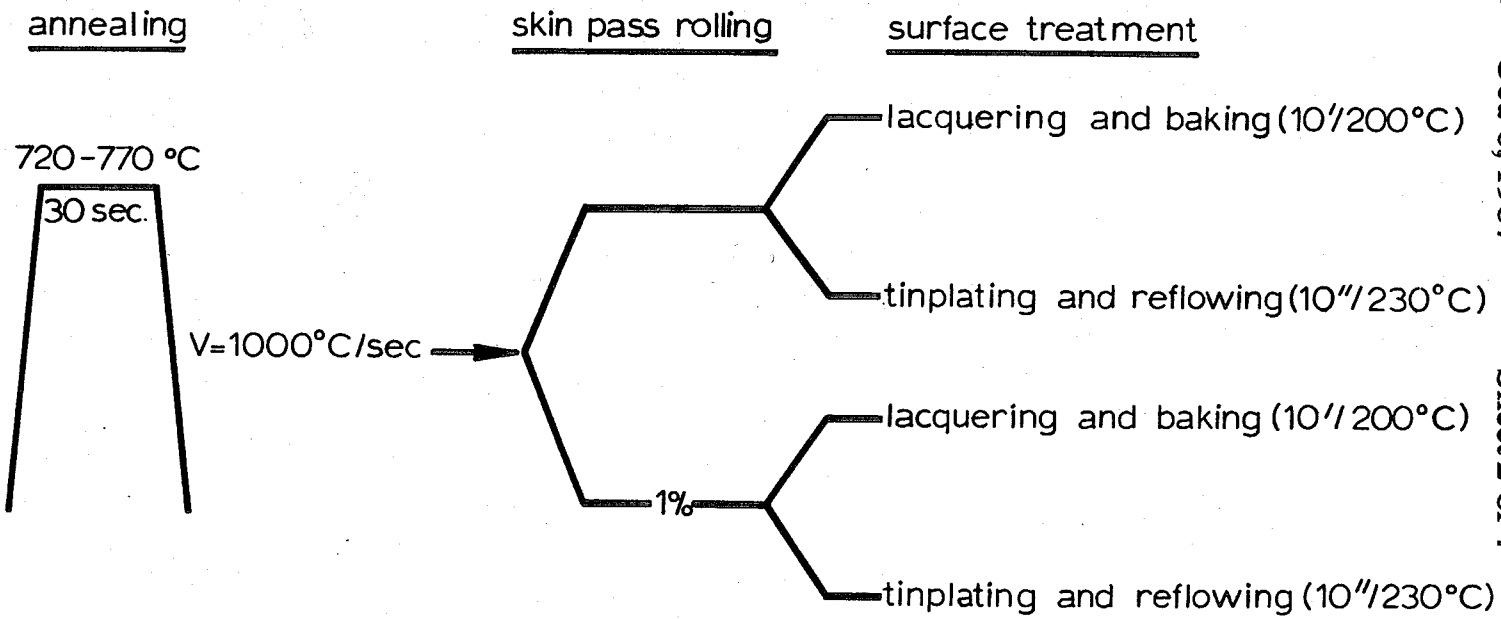
FIG. 2 shows the process steps of treating the steel of FIG. 1 after cold rolling.

The treatment after cold rolling is shown in FIG. 2 of the accompanying drawings. The cold rolled steel was continuously annealed for 30 seconds, then cooled at a rate of about 1000° C./sec. (P value 220 mm °C./sec).

As FIG. 3 indicates, some of the continuously annealed steel was skin pass rolled with a reduction of 1%. Sections of both the skin pass rolled steel and the non-skin pass rolled steel were lacquered and tinned. The lacquer on the lacquered steel was baked for 10 minutes at 200° C. This also tempered the steel. The layer of tin on the tinned steel was reflowed for 10 seconds at 230° C., while tempering the steel.

In more detail, the conditions of heating were varied along the length of the strip. Various parts of the strip were heated to different temperatures in the range 720°–770° C. and soaked at the chosen tempeature. Below 750° C. is preferred, to reduce the risk of strip fracture. After the soaking ended, a time interval which varied in the range 0.4 to 0.8 sec. ensued before the beginning of cooling. Cooling was performed by a conventional mist jet system which cools evenly and at a lower rate than cold water quenching. The mist jet system directed a mixture of water and gas ($N_2$) under pressure at the strip. Uninterrupted cooling took place down to below 250° C. at an average rate of 1000° C./sec. No over-aging was performed.

All the parts of the strip treated in accordance with these conditions had the desired dual phase structure and had consistent tensile strength, hardness, yield point and elongation values as given in the table of FIG. 3.

In FIG. 3,

VGLR = yield point in N/mm$^2$
TRST = tensile strength in N/mm$^2$
R30T = hardness (Rockwell)
$A_{80}$ = elongation at fracture over 80 mm in %.

Figure 4:
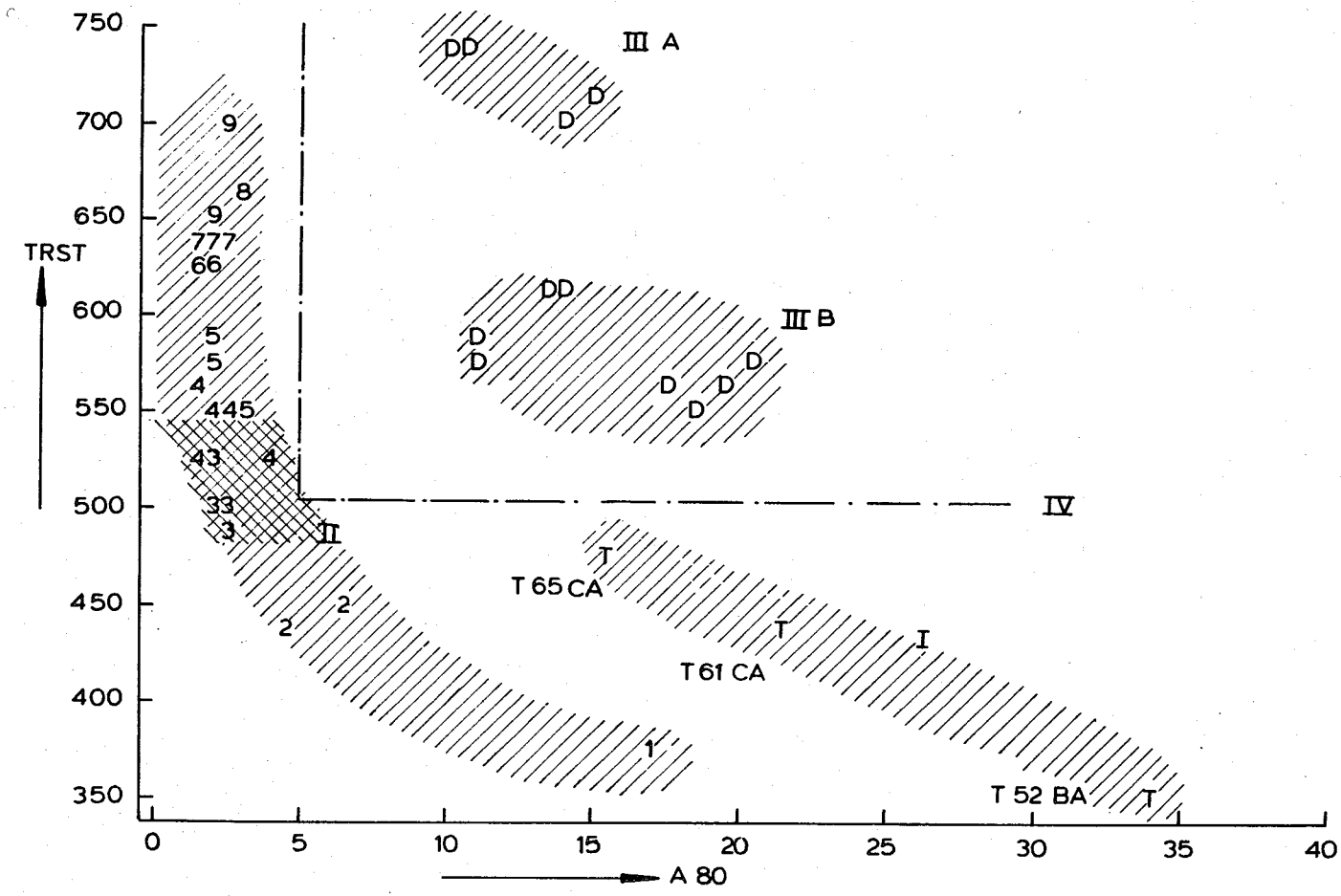
FIG. 4 shows a graph comparing the steel of the invention with known packing steels.

These results are also indicated, and compared with packing steels manufactured by a conventional method, in the graph of FIG. 4 in which the tensile strength in N/mm$^2$ along the vertical axis is plotted against the elongation $A_{80}$, in percent, along the horizontal axis.

The qualities T 52 BA (annealed in a bell type annealing furnace) and T 61CA and T 65CA (continuously annealed) manufactured by a conventional route, i.e. cold rolled and annealed qualities, characterised by a comparatively low tensile strength and high elongation, are shown at the bottom right of FIG. 4, in a shaded area I.

Double cold rolled (DR) qualities 1 to 9, i.e. with a reduction after annealing of 10 to 90% are shown at the bottom and top left, in a shaded area II. The normal DR qualities from the double shaded part of area II, with a reduction of 30 to 40% are characterised by a higher tensile strength with a comparatively low elongation.

The properties of the dual phase packing steel of the invention (III A not tempered, III B tempered), are shown at the top right in the shaded areas III A and B. The dual phase packing steel of the invention is characterised by a combination of tensile strength and elongation in the area enclosed by line IV.

What is claimed is:

1. A method of manufacturing a dual phase steel in the form of a strip of thickness in the range 0.1 to 0.5 mm from an unalloyed low C, low Mn steel composition having by weight 0.02–0.15% C
0.15–0.50% Mn comprising the steps of hot rolling
cold rolling
continuous annealing the said continuous annealing comprising (a) heating the strip to a temperature not exceeding 770° C. in the $A_1$–$A_3$ region of the iron-carbon diagram and soaking it at said temperature and thereafter
(b) cooling the strip at a rate sufficiently rapid that austenite is at least partly converted to martensite and/or bainite, said cooling rate being such that the value P=d.V where d is the strip thickness in mm and V is the average cooling rate in °C./sec over the temperature range 700° to 300° C., is in the range 20 to 900, wherein the time interval between the end of step (a) and the beginning of step (b) is less than 4 seconds.

2. A method according to claim 1 wherein the thickness of the strip is in the range 0.1 to 0.3 mm.

3. A method according to any of claims 1 and 2 wherein in step (a) the strip is heated to a temperature not exceeding 750° C.

4. A method according to claim 1 wherein in step (b) the said value P is in the range 40 to 750.

5. A method according to claim 4 wherein in step (b) the said value P is in the range 75 to 500.

6. A method according to any one of claims 1, 2 and 4 wherein the said time interval between the end of step (a) and the beginning of step (b) is less than 2 seconds.

7. A method according to any one of claims 1, 2 and 4 wherein the said time interval between the end of step (a) and the beginning of step (b) is less than 1 second.

8. A method according to any one of claims 1, 2 and 4 wherein the said time interval between the end of step (a) and the beginning of step (b) is less than 0.5 seconds.

9. A method according to any one of claims 1, 2 and 4 wherein the cooling in step (b) is performed by means of a mist jet in the form of a gas jet containing finely divided coolant liquid which is directed at the strip.

10. A method according to any one of claims 1, 2 and 4 wherein the steel is an Al killed steel and contains by weight 0.02–0.15% C
0.15–0.50% Mn
not more than 0.02% P
not more than 0.03% Si
not more than 0.065% $Al_{as}$
not more than 0.02% S
not more than 50 ppm N
balance Fe and unavoidable impurities.

11. A method according to claim 1, wherein the steel is tempered after the continuous annealing.

12. A method according to claim 11 wherein the steel is tempered at a temperature of about 230° C. for about 5 to 10 seconds.

13. A method according to one of claims 11 and 12 wherein the tempering takes place together with melting of a layer of tin electrolytically applied to the steel.

14. A method according to claim 11, wherein the steel is tempered at a temperature of about 200° C. for about 10 minutes.

15. A method according to one of claims 11 and 14 wherein the tempering takes place during hardening of a layer of varnish applied to the steel.

16. Steel strip with a thickness in the range 0.1 to 0.5 mm, manufactured by a method according to claim 1 and having a tensile strength of greater than 500N/mm$^2$ and elongation at rupture $A_{80}$ of greater than 5%.

17. Steel strip with a thickness in the range 0.1 to 0.5 mm, manufactured by a method according to claim 1 which is in quality T65 or quality T70 or in a quality which corresponds in terms of hardness to double cold rolled DR8 or DR9.

18. In a method of manufacturing a dual phase steel in the form of a strip of thickness in the range 0.1 to 0.5 mm from an unalloyed low C, low Mn steel composition having by weight 0.02–0.15% C
0.15–0.50% Mn comprising the steps of hot rolling
cold rolling
continuous annealing the continuous annealing comprising (a) heating the strip into the $A_1$–$A_3$ region of the iron-carbon diagram and soaking it in said region and thereafter
(b) cooling the strip sufficiently rapidly that austenite is at least partly converted to martensite and/or bainite the improvement that in said step (a) the strip is heated to a temperature not exceeding 770° C., in said step (b) the strip is cooled at a rate such that the value P=d.V where d is the strip thickness in mm and V is the average cooling rate in °C./sec over the temperature range 700° to 300° C., is in the range 20 to 900 and the time interval between the end of step (a) and the beginning of step (b) is less than 4 seconds.

* * * * *